US005170314A

United States Patent [19]

Saito

[11] Patent Number: 5,170,314

[45] Date of Patent: Dec. 8, 1992

[54] CHARGING APPARATUS

[75] Inventor: Taku Saito, Hachioji, Japan

[73] Assignee: Konica Corporation, Japan

[21] Appl. No.: 470,861

[22] Filed: Jan. 26, 1990

[30] Foreign Application Priority Data

Feb. 3, 1989 [JP] Japan ..... 1-26061
Feb. 3, 1989 [JP] Japan ..... 1-26064

[51] Int. Cl.[5] ..... H01T 19/00

[52] U.S. Cl. ..... 361/212; 361/225; 15/246

[58] Field of Search ..... 15/246, 256.5; 361/212, 361/225

[56] References Cited

U.S. PATENT DOCUMENTS 4,566,777 1/1986 Honda et al. ..... 361/225

FOREIGN PATENT DOCUMENTS 2424835 1/1975 Fed. Rep. of Germany ..... 15/246.

*Primary Examiner*—Steven L. Stephan

*Assistant Examiner*—Thomas M. Dougherty

*Attorney, Agent, or Firm*—Jordan B. Bierman

[57] ABSTRACT

A discharge wire cleaning apparatus having a cleaning member adapted to clean a discharge wire, which is used in a corona discharge device and supported so that the wire extends in the lengthwise direction of a back plate of the corona discharge device. An elongated guide groove, which has an opened portion parallel to the discharge wire, is provided in the back plate, and a shaft portion of the cleaning member is fitted slidably in this guide groove, the opened portion of the guide groove restricting the cleaning member so that the cleaning member can be moved in parallel with the discharge wire. The cleaning member can be turned at one end of the guide groove so as to be separated from the discharge wire. A rope is fitted through the shaft portion of the cleaning member and moved by a driving power source to enable the cleaning member to be moved slidingly in the guide groove in the lengthwise direction thereof.

4 Claims, 8 Drawing Sheets

CHARGING APPARATUS

BACKGROUND OF THE INVENTION

1. Field of the Invention

This invention relates to an improvement in a cleaning device for high-voltage discharge wires provided as a charging electrode, a transfer electrode and a separating electrode in an image recording apparatus, such as a reproducing machine, a printer and an electric transmission apparatus.

2. Description of the Prior Art

In an image recording apparatus, such as a reproducing machine, discharge wires are provided for a charging electrode or a transfer electrode and a separating electrode which are used to charge a photosensitive member or transfer an image onto a recording medium. When toner or extraneous matter is deposited on, for example, a discharge wire for the charging electrode, an uneven portion called a white streak or a white band occurs on a recorded surface, such as a copy surface. The transfer electrode is used to carry out the transfer of a toner image by applying an electric charge of a high corona voltage, the polarity of which is opposite to that of the toner charge, to the transfer paper, which is superposed on the toner image on a photosensitive body, from the rear side thereof. When the transfer paper is separated, the scattering of the toner is liable to occur, and the toner scattered during this operation is deposited on a discharge wire for the transfer electrode.

In order to prevent these problems from arising, an apparatus for cleaning the discharge wires is provided.

Such cleaning apparatuses have been proposed by Japanese Patent Publication No. 54-8102 and Japanese Utility Model Publication No. 51-1830. In the cleaning apparatus proposed by Japanese Utility Model Publication No. 47-30458, the cleaning of the discharge wires has to be done with a charging device removed from a machine body. Therefore, the handling of the cleaning apparatus becomes troublesome, and a discharge wire cleaning operation takes much time.

The drawbacks common to all of the proposed cleaning apparatuses referred to above reside in that these apparatuses employ a structure in which a cleaning member fixes the wires under pressure or presses the same even during a charging operation. Therefore, the toner is apt to be deposited on the wires, and the leakage of the toner occurs. This causes the electric potential to decrease, and the positions of the electrodes to be biased, so that the distribution of electric charges becomes uneven.

In the conventional cleaning members, a portion opposed to a discharge wire consists of a brush or an implanted hair-pasted member but it is difficult to remove the extraneous matter, such as toner, paper powder and dust, which is stuck to the surface of the discharge wire, therefrom by such a cleaning member. Moreover, when the brush or implanted hair is left in a bent state after it is used for a long period of time, the cleaning effect thereof greatly decreases.

In another type of conventional cleaning apparatus used in a large number, a felt type cleaning member adapted to be moved with the cleaning member surface-contacting a discharge wire under pressure is employed. When this type of cleaning member is used, extraneous matter is apt to be held between the pressure-contacting surfaces of the cleaning member and discharge wire. This causes the cleaning effect to decrease, extraneous matter to be stuck to the discharge wire, and extraneous matter to rub and hurt the discharge wire. In any of these types of cleaning apparatuses, a brush or implanted hair or felt is required.

In any of these types of cleaning apparatuses, unremoved extraneous matter remains in large quantities on the circumferential surface of a discharge wire. Therefore, the corona current levels occurring in the discharge wires for a charging device, a transfer device and a separating device decrease, and uniform current levels over the whole lengths of these wires cannot be obtained.

When electric discharge is effected with a discharge wire left contacting the cleaning member, the discharge condition at the contacting portions become abnormal, and the charging potential on the photosensitive body varies. In such a case, it is difficult to record a satisfactory image.

Consequently, it is necessary that a cleaning member and a discharge wire, which are in contact with each other during a cleaning operation, be disengaged from each other automatically during a charging operation.

In general, since a cleaning apparatus is fixed to these electrodes, a large space is required, i.e., a cleaning apparatus has a large spatial restriction. In other words, the provision of a cleaning mechanism causes the dimensions of the apparatus to increase, and the designing of the apparatus to be largely restricted.

SUMMARY OF THE INVENTION

The present invention has been developed with a view to solving these problems. An object of the present invention is to provide a discharge wire cleaning apparatus capable of reliably and efficiently cleaning a discharge wire, even the discharge wire to which dirt is firmly stuck.

Another object of the present invention is to provide a wire cleaning apparatus for corona discharge devices, which is capable of being formed to a highly reliable structure in spite of the presence of a large spatial restriction.

A discharge wire cleaning apparatus according to the present invention which can achieve these objects is provided with a cleaning member adapted to clean a discharge wire, which extends in the lengthwise direction of an elongated frame type back plate, as the cleaning member is moved slidingly on the surface of the wire, the cleaning member being formed out of a resin so that an end surface of a cleaning portion, which contacts the discharge wire, of the cleaning member has a scoop angle of not less than 90° with respect to the direction in which the cleaning member advances.

Still another object of the present invention is to provide a wire cleaning apparatus for corona discharge devices, which is capable of carrying out a wire cleaning operation reliably and separating a cleaning member from a wire during a charging operation.

This object can be achieved by a discharge wire cleaning device provided with a cleaning member adapted to clean a discharge wire as the cleaning member is moved slidingly on the surface of the wire, which discharge wire is used in a corona discharge device consisting of an elongated frame type back plate composed of side walls and a bottom plate, said discharge wire being supported so that the wire extends in the lengthwise direction of the back plate, an elongated guide groove, which has an opened portion parallel to the discharge wire, being provided in the back plate, a shaft portion of the cleaning member being fitted slidably in this guide groove, the opened portion of the guide groove restricting the cleaning member so that the cleaning member can be moved in parallel with the discharge wire, the cleaning member being formed so that it can be turned at one end of the guide groove so as to be separated from the discharge wire.

The discharge wire cleaning apparatus according to the present invention is further provided with a rope fitted through the shaft portion of the cleaning member and moved by a driving power source to enable the cleaning member to be moved slidingly in the guide groove in the lengthwise direction thereof.

Owing to the employment of such construction, a cleaning apparatus capable of being set in a narrow space and having stable functions can be obtained.

The above and other objects as well as advantageous features of the invention will become apparent from the following description of the preferred embodiments taken in conjunction with the accompanying drawings.

DESCRIPTION OF THE PREFERRED EMBODIMENTS

Figure 5:
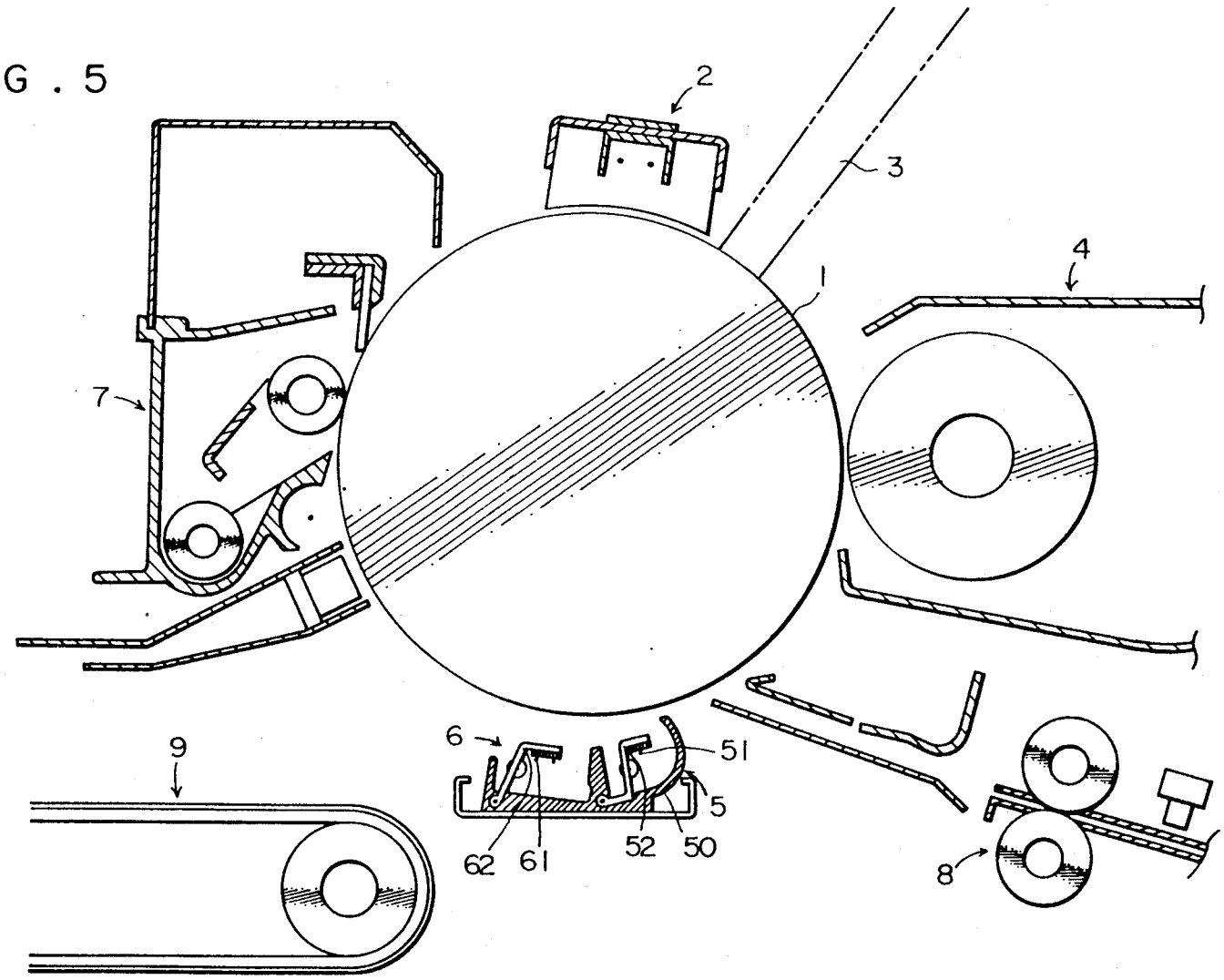
FIG. 5 is a sectional view of a principal portion of an image forming apparatus provided with a corona discharge device to which the present invention is applied.

An embodiment of the present invention is shwon in FIG. 5.

FIG. 5 is a sectional view of a principal portion of an image forming apparatus provided with a corona discharger according to the present invention. Referring to the drawing, a reference numeral 1 denotes a photosensitive drum supported rotatably on an image forming apparatus body. A photoconductive photosensitive layer is provided on the outer circumferential surface of the photosensitive drum 1, and various steps are carried out during a rotation of the drum 1 to form a recorded image. A charging device 2 for applying electric charges to the photosensitive drum 1, an image forming beam 3, with which a document image is exposed, from an optical system, a developing device 4 for depositing toner electrostatically on an electrostatic latent image to form a visible toner image, a transfer device 5 for transferring the toner image onto recording paper, a separating device 6 for separating the transferred toner image-carrying recording paper from the photosensitive drum 1, and a cleaning unit 7 for removing the residual toner from the surface of the photosensitive drum 1 after the completion of the image transfer step are provided around the same photosensitive drum 1. The transfer device 5 is provided with a feed means 8 for supplying recording paper to the drum 1, a transfer means 9 for sending the transferred image-carrying separated recording paper to a fixing device, and a paper discharge mechanism (not shown).

Figure 1:
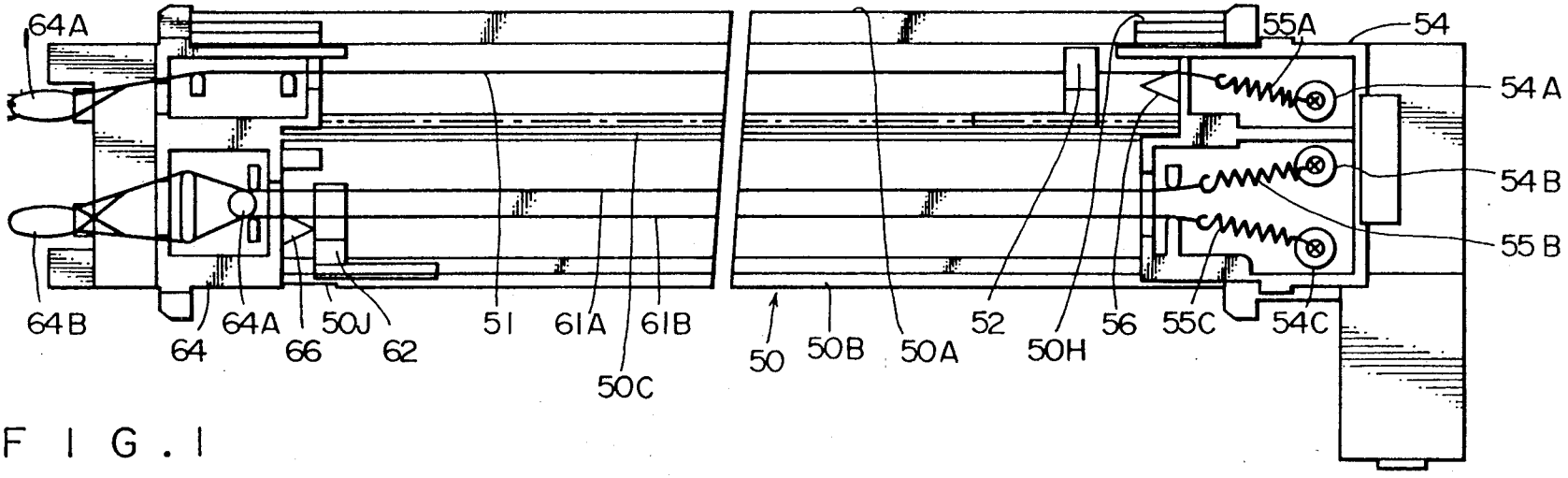
FIG. 1 is a plan view of a discharge device of the type in which a transfer device and a separating device are unitarily combined, the discharge device being an embodiment illustrated of the present invention.
Figure 2:
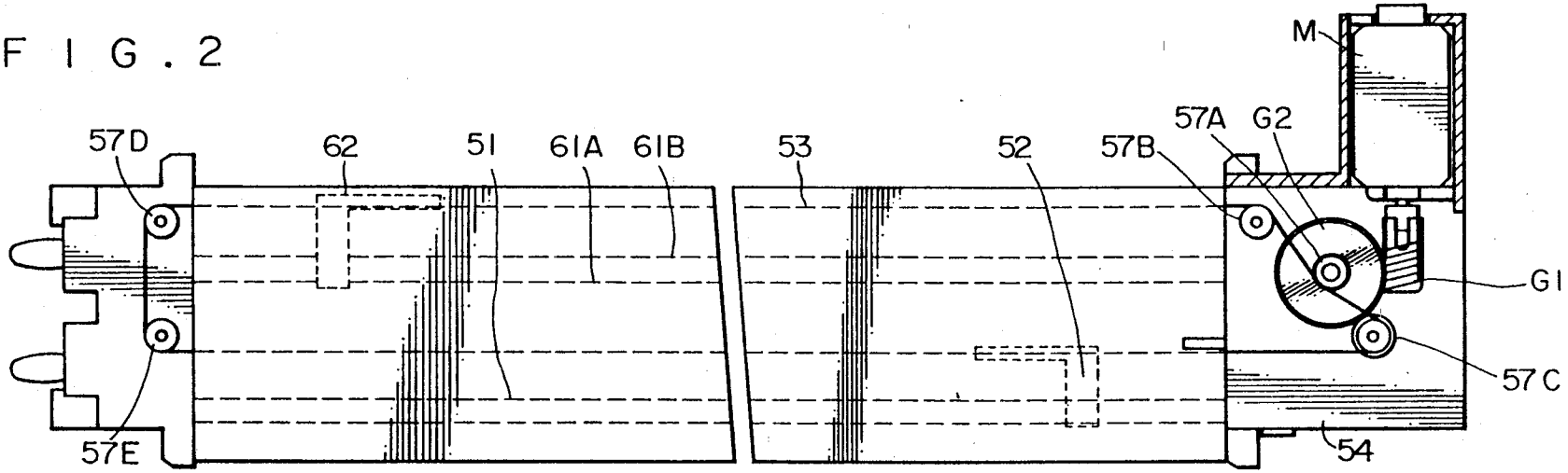
FIG. 2 is a bottom view of the discharge device.

FIG. 1 is a plan view of a discharge device of the type in which a transfer device and a separating device are unitarily combined, the discharge device being an embodiment illustrated of the present invention, and FIG. 2 a bottom view of these devices.

Referring to these drawings, a reference numeral 50 denotes a back plate common to the transfer device 5 and separating device 6. This back plate 50 consists of two side walls 50A, 50B, a central partition wall 50C, and bottom walls 50D, 50E, and has a both end-opened elongated double-channeled frame structure. The back plate 50 is formed integrally by an extrusion molding process.

A guide groove 50F having an opened portion is provided in the base portion, which is close to the bottom wall 50D, of the central partition wall 50C. A guide groove 50G having an opened portion is provided in the base portion, which is close to the bottom wall 50E, of one side wall 50B.

A transfer discharge wire 51 is extended in a space defined by the side wall 50A, central partition wall 50C and bottom wall 50D. Two separating discharge wires 61A, 61B are extended in a space defined by the side wall 50B, central partition wall 50C and bottom wall 50E.

A reference numeral 52 denotes a cleaning member for use in cleaning the transfer discharge wire 51, the cleaning member 52 consisting of an upper edge portion 521, a lower edge portion 522, an arm portion 523, and a shaft portion 524 fitted slidably in the guide groove 50F. Similarly, a reference numeral 62 denotes a cleaning member for use in cleaning the separating discharge wires 61A 61B, the cleaning member 62 consiting of an upper edge portion 621, a lower edge portion 622, an arm portion 623, and a shaft portion 624 fitted slidably in the guide groove 50G.

These shaft portions 524, 624 are formed tubularly, and ropes 53 are inserted fixedly therethrough.

A driving unit for these cleaning members 52, 62 will now be described.

Retainer members 54, 64 are fixed to the opened portions at both ends of the elongated frame type back plate 50.

One end portion of the discharge wire 51 for the transfer device 5 is fixed to the upper surface of the left end retainer member 64 shown in FIG. 1, and the other end portion thereof engaged with a coiled spring 55A attached to a fixing member 54A on the right end retainer member 54, the discharge wire 51 for the transfer device 5 being thus extended and supported in a tensed state.

Similarly, one end portion of each of the separating discharge wires 61A, 61B is engaged with a left end plug 64B on the retainer member 64, and the other end of each thereof engaged with coiled springs 55B, 55C attached to fixing members 54B, 54C on the retainer member 54, the discharge wires 61A, 61B being thus extended and supported in a tensed state.

A conical project member 56 is formed integrally with and at a predetermined portion of the right end retainer member 54, and adapted to engage and disengage from the cleaning member 52 for use in cleaning the transfer discharge wire 51. Similarly, a project member 66 provided on the left end retainer member 64 is adapted to engage and disengage from the cleaning member 62 for use in cleaning the separating discharge wires 61.

Referring to FIG. 2, a motor M is provided in the interior of a frame for the right end retainer member 54, and a worm G1 formed integrally with a driving shaft of the motor M is meshed with a worm wheel G2 to rotate a V-pulley 57A fixed coaxially with the worm wheel G2. A rope 53 wound around the V-pulley 57A is passed around a V-pulley 57B supported rotatably on the retainer member 54, a tension pulley 57C, and V-pulleys 57D, 57E supported rotatably on the retainer member 64, to form a closed loop.

The cleaning members 52, 62 are fixed to predetermined intermediate portions of this rope and can be moved slidingly in the lateral direction along the guide grooves 50F, 50G in accordance with the movement of the rope 53.

Figure 6:
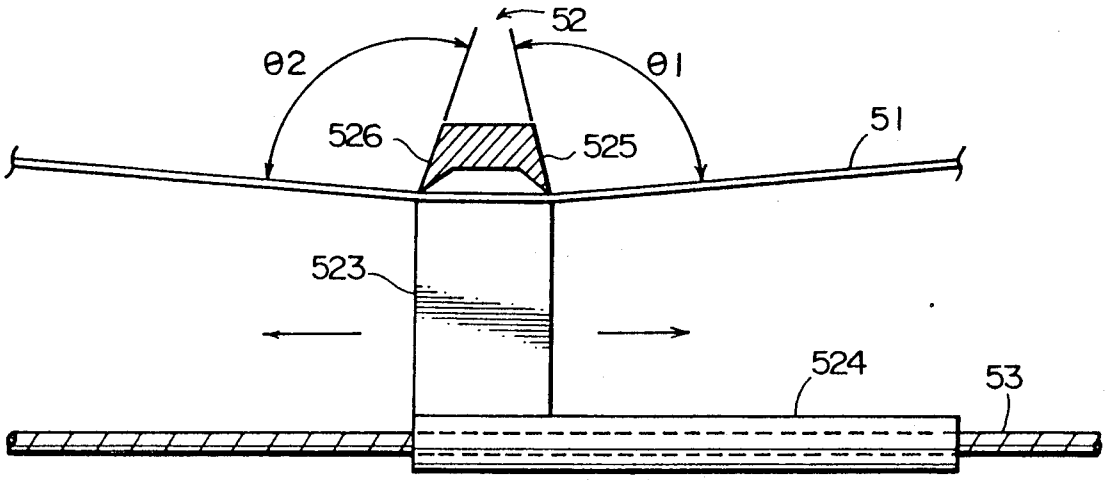
FIG. 6 is a front elevation of another example of the cleaning member in the present invention.

FIG. 6 is a front elevation of another example of the cleaning member in the present invention. Referring to this drawing, the parts having the same functions as those of the above-described embodiment are designated by the same reference numerals. The differences between the example of FIG. 6 and the cleaning member in the above embodiment will be described.

A cleaning member 52 of the example of FIG. 6 is provided at a portion thereof which is close to the upper end thereof with right and left edge portions 525, 526, the end sections of which extend so as to pressure-engage a discharge wire 51 with obtuse scoop angles $\theta 1$, $\theta 2$ of not less than 90° formed with respect thereto. The discharge wire 51 is pressed and bent by the end sections mentioned above, whereby a pressing force of a suitable level is applied to the wire.

The cleaning member 52 is driven laterally with this pressed condition maintained. When the cleaning member 52 is moved to right (forward), the discharge wire 51 is cleaned at the angle 81 of the right edge portion 525, and, when the cleaning member 52 is moved to left (backward), the wire 51 is cleaned at the angle $\theta 2^2$ of the left edge portion 526.

Figure 7A:
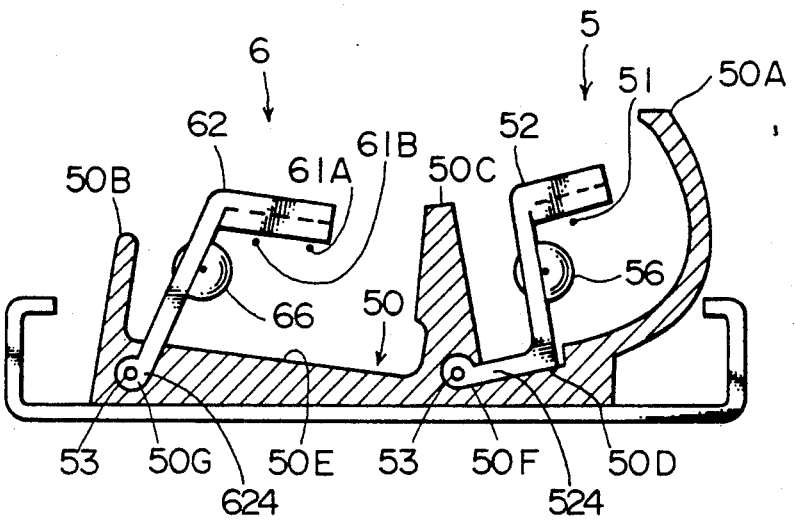
FIGS. 7A and 7B are sectional views of transfer and separating devices.
Figure 7B:
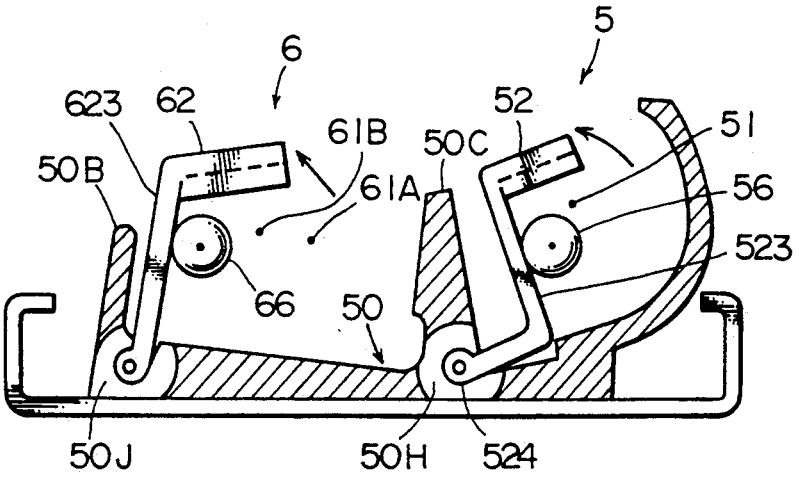
Figure 8A:
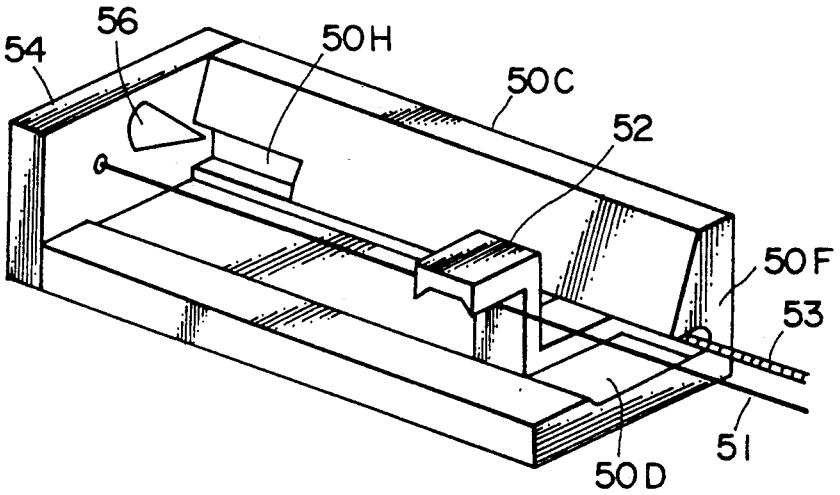
FIGS. 8A and 8B are perspective views of a part of the transfer and separating devices.
Figure 8B:
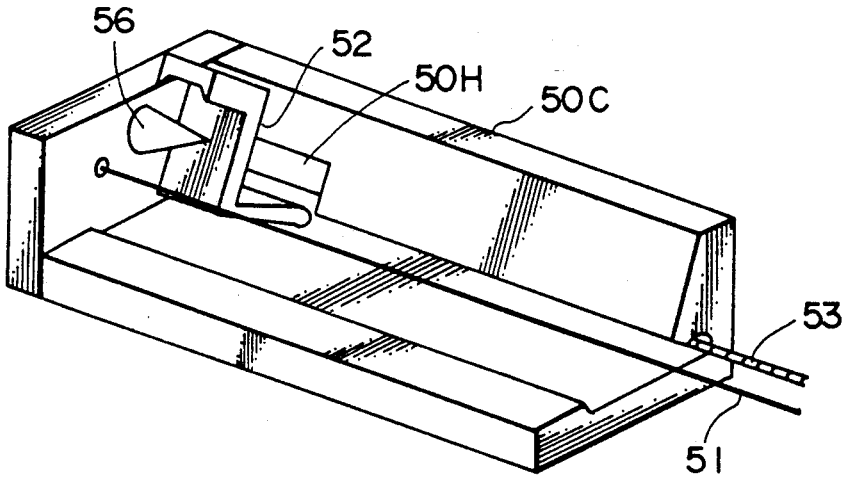

FIGS. 7A and 7B are sectional views of the transfer device 5 and separating device 6, and FIGS. 8A and 8B perspective views of a principal portion of the transfer device 5. FIGS. 7A and 8A illustrate the cleaning members in a discharge wire cleaning operation, and FIGS. 7B and 8B the cleaning members released from a discharge wire cleaning operation.

While the cleaning member 52 is in a cleaning operation in which the cleaning member 52 is moved in pressure-contact with the transfer discharge wire 51, the bottom portion of the cleaning member 52 surface-contacts a bottom surface portion 50D, which is in the vicinity of the opened portion of the guide groove 50F at the bottom portion of the central partition wall 50C, of the back plate 50 as shown in the sectional view of FIG. 7A, and the shaft portion 524 of the cleaning member 52 fits in the guide groove 50F with a neck of the shaft portion 524 locked by a projection at the bottom portion of the central partition wall 50C to render the shaft portion 524 unpivotable. The cleaning member 52 in this condition is moved in parallel with the transfer discharge wire 51 by the driving force of the rope 53 to carry out a wire cleaning operation.

Similarly, the pivotal movement of the base portion of the cleaning member 62 is also stopped due to the specially shaped neck of the base portion of the side wall 50B of the back plate 50, the cleaning member 62 being capable of moving along the guide groove 50G.

The section of the bottom portion of the central partition wall 50C of the back plate 50 which is in the vicinity of the right end retainer member 54 is cut out to form a recess 50H. At this portion of the back plate which is close to the right end thereof, the cleaning member 52 is in a pivotable state with the shaft portion 524 fitted in the guide groove 50F.

When the cleaning member 52 is moved close to the right end retainer member 54 by the driving force of the rope 53, the conical portion of the project member 56 slidingly contacts the arm portion 523 of the cleaning member 52, so that the cleaning member 52 is turned in the direction of an arrow in FIG. 7B and disengaged from the transfer discharge wire 51.

Similarly, the section of the bottom portion of the side wall 50B of the back plate 50 which is in the vicinity of the left end retainer member 64 is cut out to form a recess 50J. At this portion of the back plate 50 which is close to the left end thereof, the cleaning member 62 is in a pivotable state with the shaft portion 624 fitted in the guide groove 50G.

When the cleaning member 62 is moved close to the left end retainer member 64 by the driving force of the rope 53, the conical portion of the project member 66 slidingly contacts the arm portion 623 of the cleaning member 62, so that the cleaning member 62 is turned in the direction of an arrow in FIG. 7B and disengaged from the separating discharge wires 61.

Figure 9B:
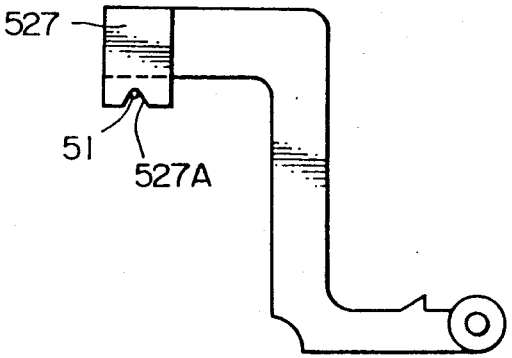
FIGS. 9A and 9B are a sectional view and a side elevation of still another example of the cleaning member in the present invention.
Figure 9A:
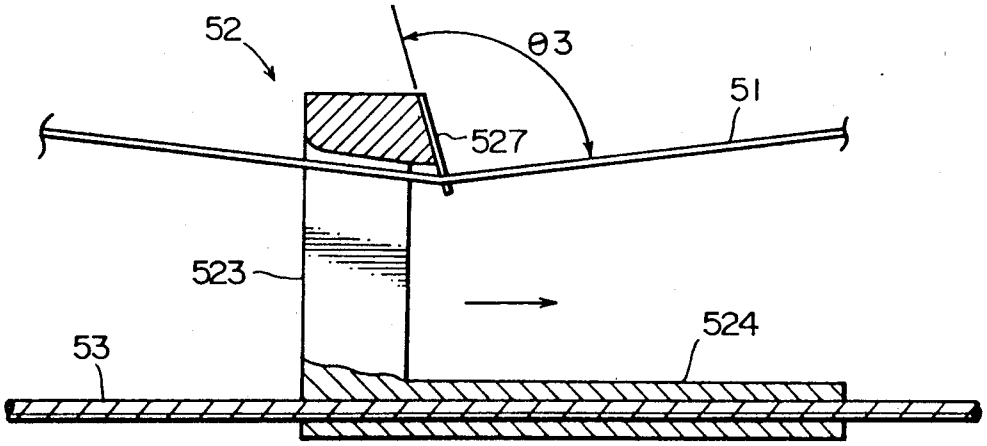

FIG. 9A is a sectional view of still another example of the cleaning member in the present invention, and FIG. 9B a side elevation of this example.

A thin flexible plate 527 is fixed to the upper part of an arm portion 523 of a cleaning member 52 so as to form an obtuse scoop angle $\theta 3$ of not less than 90°. The thin flexible plate 527 consists, for example, of film type polyethylene terephthalate (PET), and has a V-shaped recess 527A in the lower portion of its flat surface. The bottom portion of this recess 527A is shaped arcuately so that that the curvature of the bottom portion is substantially equal to that of a cross section of the discharge wire 51. Owing to the arcuate shape of the recess 527A, the circumferential surface of the discahrge wire 51 widely contacts the recess 527A. Accordingly, the extraneous matter, such as toner deposited on the circumferential surface of the wire 51 is scraped off in accordance with the movement of the cleaning member 52, so that a clean wire surface appears widely.

A thin flexible plate similar to the abovementioned thin flexible plate is attached to the cleaning member 62 as well for the separating device 6, and the same effect can be obtained. If the project means shown in FIGS. 7A, 7B, 8A and 8B is provided, the cleaning member can be separated from the discharge wire and held away therefrom by releasing the pressure from the cleaning member when a copying operation is not carried out.

In the above statement, the present invention is described as a cleaning apparatus for a transfer device and a separating device. The present invention can also be used for cleaning a wire in a charger and a charge remover. Moreover, the present invention is capable of being made by many other methods and providing many modified examples without being limited to the above embodiments. Therefore, these methods and modifications are all included in the scope of the claims of the present invention.

According to the discharge wire cleaning apparatus of the present invention, the cleaning member is moved accurately along the guide groove and in parallel with the discharge wire, so that the discharge wire can be cleaned reliably and kept clean at all times. Especially, since the cleaning member press-contacts and frictionally moves on the discharge wire with the free end portions of the cleaning member forming scoop angles, an excellent cleaning effect can be obtained. Consequently, the image forming process including charging, transfer and separating steps is stabilized, and an excellent copied image is obtained.

Figure 10:
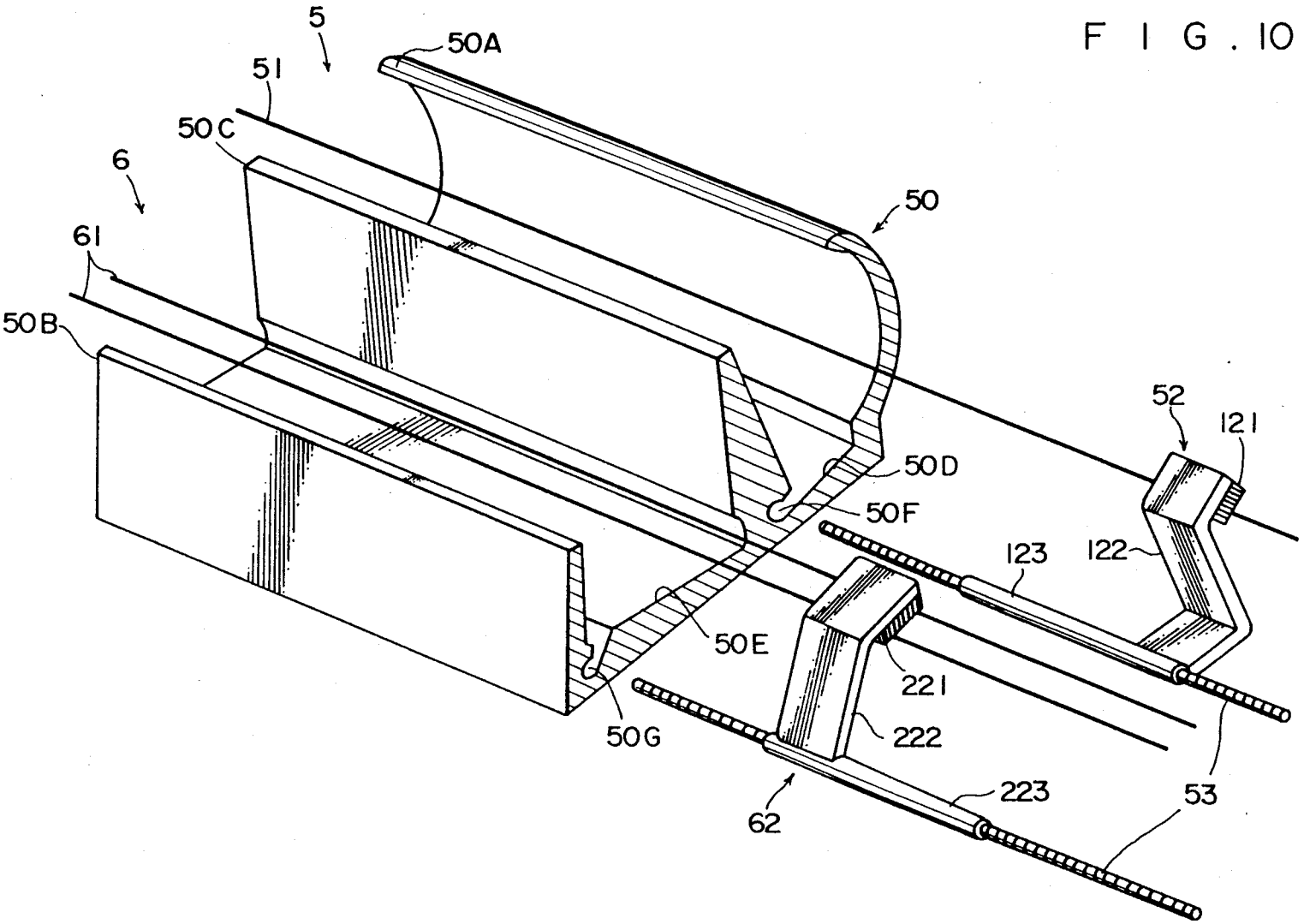
FIG. 10 is an exploded view in perspective of a principal portion of a discharge device of the type in which a transfer device and a separating device are unitarily combined, the discharge device being another embodiment illustrated of the present invention.

FIG. 10 is an exploded view in perspective of a principal portion of a discharger of the type in which a transfer device and a separating device are unitarily combined, which discharge device employs another embodiment illustrated of the present invention.

Referring to FIG. 10, a reference numeral 52 denotes a cleaning member for use in cleaning a transfer discharge wire 51, the cleaning member 52 consisting of an arm portion 122 retaining a cleaning piece 121, and a shaft portion 123 fitted slidably in a guide groove 50F. Similarly, a cleaning member 62 for use in cleaning separating discharge wires 61 consists of an arm portion 222 retaining a cleaning piece 121, and a shaft portion 223 fitted slidably in a guide groove 50G.

These shaft portions 123, 223 are all made tubular, and ropes 53 are inserted fixedly therethrough.

Figure 3A:
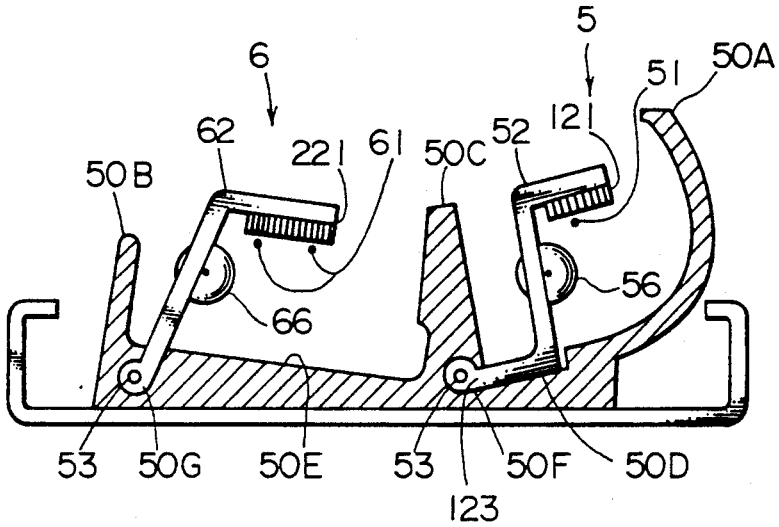
FIGS. 3A and 3B are sectional views of this combined type discharge device.
Figure 3B:
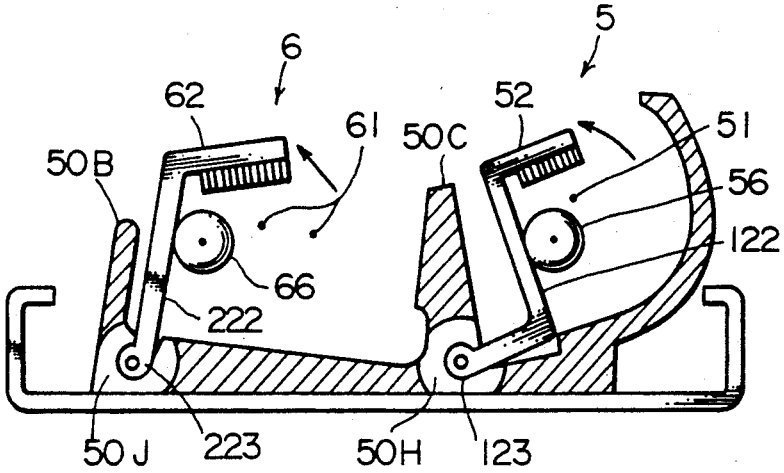

FIGS. 3A and 3B are sectional views of a transfer device 5 and a separating device 6 to which this embodiment is applied. FIG. 3A shows the discharge wire cleaning condition of the cleaning member and FIG. 3B shows the cleaning member released from the discharge wire cleaning operation.

While the cleaning member 52 is in a cleaning operation in which the cleaning member 52 is moved in pressure-contact with the transfer discharge wire 51, the bottom portion of the cleaning member 52 surface-contacts a bottom surface portion 50D, which is in the vicinity of the opened portion of the guide groove 50F at the bottom portion of the central partition wall 50C, of the back plate 50 as shown in the sectional view of FIG. 3A, and the shaft portion 123 of the cleaning member 52 fits in the guide groove 50F with a neck of the shaft portion 123 locked by a projection at the bottom portion of the central partition wall 50C to render the shaft portion 123 unpivotable. The cleaning member 52 in this condition is moved in parallel with the transfer discharge wire 51 by the driving force of the rope 53 to carry out a wire cleaning operation.

Similarly, the pivotal movement of the base portion of the cleaning member 62 is also stopped due to the specially shaped neck of the base portion of the side wall 50B of the back plate 50, the cleaning member 62 being capable of moving along the guide groove 50G.

The section of the bottom portion of the central partition wall 50C of the back plate 50 which is in the vicinity of the right end retainer member 54 is cut out to form a recess 50H. At this portion of the back plate which is close to the right end thereof, the cleaning member 52 is in a pivotable state with the shaft portion 123 fitted in the guide groove 50F.

When the cleaning member 52 is moved close to the right end retainer member 54 by the driving force of the rope 53, the conical portion of the project member 56 slidingly contacts the arm portion 122 of the cleaning member 52, so that the cleaning member 52 is turned in the direction of an arrow in FIG. 3B and disengaged from the transfer discharge wire 51.

Similarly, the section of the bottom portion of the side wall 50B of the back plate 50 which is in the vicinity of the left end retainer member 64 is cut out to form a recess 50J. At this portion of the back plate 50 which is close to the left end thereof, the cleaning member 62 is in a pivotable state with the shaft portion 223 fitted in the guide groove 50G.

When the cleaning member 62 is moved close to the left end retainer member 64 by the driving force of the rope 53, the conical portion of the project member 66 slidingly contacts the arm portion 222 of the cleaning member 62, so that the cleaning member 62 is turned in the direction of an arrow in FIG. 3B and disengaged from the separating discharge wires 61.

Figure 4A:
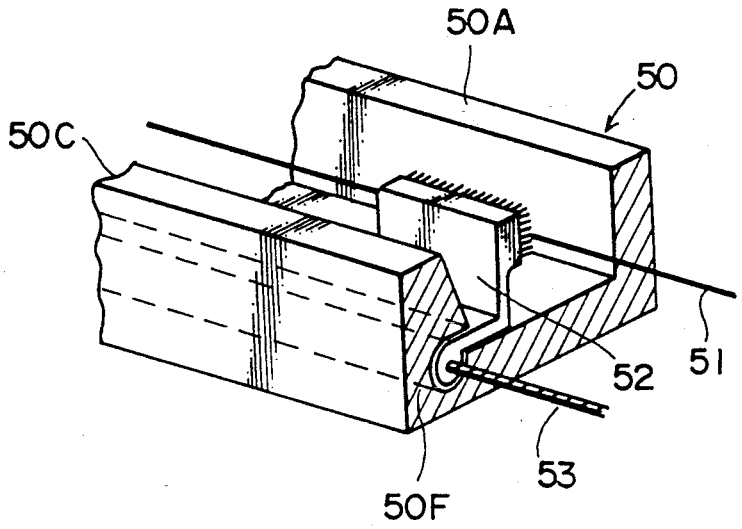
FIGS. 4A and 4B are perspective views of a principal portion of a further example of discharger to which the present invention is applied.
Figure 4B:
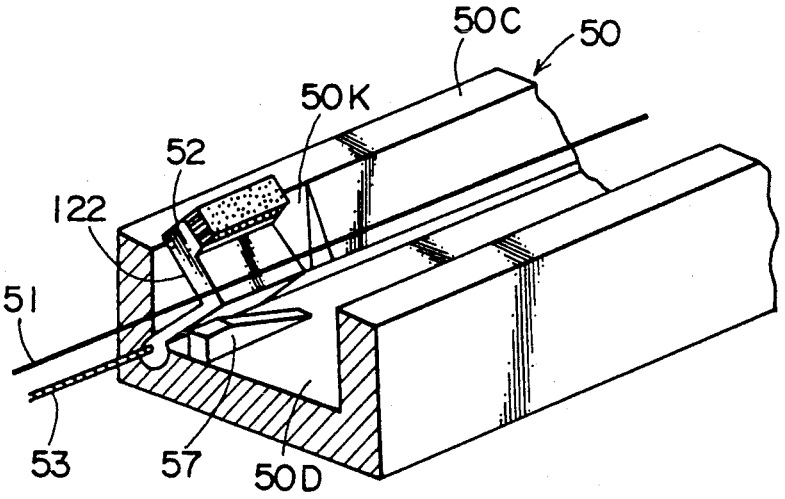

FIGS. 4A and 4B are perspective views of a principal portion of a further example of discharger to which the present invention is applied. FIG. 4A shows a cleaning member in a wire cleaning operation, and FIG. 4B the cleaning member released from the wire cleaning operation. Referring to these drawings, the parts of this example which have the same functions as those of the above-described examples are designated by the same reference numerals. The differences between the example of FIGS. 4A and 4B and the previously-described examples will be described.

In the example of FIGS. 4A and 4B, a cleaning member 52 presses a discharge wire 51 from a side portion thereof and moves linearly to clean the wire 51. The inner surface of one end portion of a back plate 50 is provided with an escape recess 50K. When the cleaning member 52 is driven by a rope 53 and reaches the mentioned portion of the back plate 50, it becomes pivotable, and an inclined surface of a wedge type project member 57 provided on a bottom surface portion 50D of the back plate 50 engages an arm portion 122 of the cleaning member 52 to lift the same. Consequently the cleaning member 52 is turned to be separated from the discharge wire 51 (refer to FIG. 4B).

Besides the conical member 56 and wedge type member 57, various shapes of members can be applied as project members for turning the cleaning member 52 to the cleaning apparatus according to the present invention. Namely, a rotatable roller and a plate spring can also be used for this purpose.

The above is a description of a cleaning apparatus for cleaning the discharge wires for a transfer device 5 and a separating device 6, and this apparatus can also be applied to the discharge wire for a charger 2.

Since the discharge wire cleaning apparatuses in the above embodiments of the present invention are capable of being automatically separated from the discharge wire after the completion of the wire cleaning operation, the discharge wire is extended in a predetermined position accurately and stably. Accordingly, the charging, transfer and separating steps can be carried out stably, and excellent copied images can be obtained.

The discharge wire cleaning apparatus according to the present invention is formed so that it can be moved in one end space in the back plate. Therefore, the present invention has a space saving effect, and is capable of attaining various other desired effects with a small number of parts.

What is claimed is:

1. A charging apparatus having a discharge wire, and a cleaning member for cleaning said discharge wire, said charging apparatus further comprising;

an elongated frame-type back plate having a side wall, a bottom plate, and a guide groove, wherein said guide groove is parallel to said discharge wire, and is in proximity to an inside corner formed by said bottom plate and said side wall, said discharge wire extending in a lengthwise direction of said back plate;

said cleaning member having a shaft portion slidable in said guide groove, and a cleaning portion, said cleaning portion being slidably movable on a surface of said discharge wire, said apparatus further comprising a driving unit for moving said cleaning member along said guide groove.

2. The apparatus of claim 1 wherein said guide groove includes a first portion whereby, when said driving unit moves said cleaning member through said first portion of said guide groove, said cleaning member cleans said discharge wire, and a second portion, on one end of said guide groove whereby, when said driving unit moves said cleaning member through said second portion, said cleaning member rotates pivotably in said guide groove, thereby separating said cleaning member from said discharge wire.

3. The apparatus of claim 1 wherein said cleaning member is formed of a resin.

4. The apparatus of claim 1 wherein an end surface of said cleaning portion of said cleaning member extends so as to be in pressure contact with said discharge wire with an obtuse scoop angle of not less than 90° with respect to the direction in which said cleaning member advances.

* * * * *